United States Patent [19]

Kallestad et al.

[11] Patent Number: 4,688,332

[45] Date of Patent: Aug. 25, 1987

[54] METHOD AND APPARATUS FOR AERATION OF STORED GRAIN

[75] Inventors: Daniel R. Kallestad, Excelsior; Kenneth I. Satre, Bricelyn, both of Minn.

[73] Assignee: Sentry Technologies, Inc., Excelsior, Minn.

[21] Appl. No.: 842,668

[22] Filed: Mar. 21, 1986

[51] Int. Cl.[4] ..... F26B 3/06; F26B 21/12

[52] U.S. Cl. ..... 34/34; 34/46; 34/54

[58] Field of Search ..... 34/54, 50, 29, 34, 46; 236/44 R, 44 C, 44 E, 49; 98/53, 55; 374/102, 103, 108

[56] References Cited

U.S. PATENT DOCUMENTS

| | | | |
|---|---|---|---|
| 3,408,747 | 11/1968 | Steffen . | |
| 3,563,460 | 2/1971 | Nine . | |
| 4,045,878 | 9/1977 | Steffen . | |
| 4,175,418 | 11/1979 | Steffen et al. . | |
| 4,471,424 | 9/1984 | Persson . | |
| 4,522,335 | 6/1985 | Kallestad et al. | 34/54 |
| 4,583,300 | 4/1966 | Mast | 34/54 |

OTHER PUBLICATIONS

*Natural Air and Low Heat Grain Drying and Storage Controller,* Duane L. Bollwitt (The Bollwitt Co., Inc.), Jan. 25, 1983, Monitcello, Iowa.

*Programmable Control for Drying and Aeration,* Gleelyn W. Persson (Pertek, Inc.), Robert W. Churchill (Hatrun Corporation), date and place of publication unknown.

Pertek, Inc. 2 page sales brochure, author, date and place of publication unknown.

*Primary Examiner*—Larry I. Schwartz

*Attorney, Agent, or Firm*—Dorsey & Whitney

[57] ABSTRACT

A method and apparatus for the controlled aeration of stored grain is disclosed that provides for aeration of grain when ambient temperature and relative humidity levels are within a specified range of optimum levels. Available daily aeration time is calculated based on the difference between grain temperature and recent average air temperature and, if not used in a given day, is accumulated. Aeration of grain is initiated when the current ambient air temperature is within an acceptable range of the recent average air temperature, the equilibrium moisture content supported by the current air temperature and relative humidity levels is within an acceptable range of the desired grain moisture content and the available aeration time has not been used up. Long periods between aeration are avoided by progressively widening the range of acceptable current ambient air temperature and equilibrium moisture content levels when less than a predetermined amount of aeration has occurred. The method also provides for the maintenance of a uniform temperature within the stored grain, and assists in avoiding extreme storage temperatures. The apparatus disclosed provides for continuous monitoring of ambient atmospheric conditions, and initiates aeration of stored grain automatically, in accordance with the inventive method, without continuous operator involvement.

18 Claims, 10 Drawing Figures

58
56
J
V
60
48
98
DISPLAY INTERFACE
74LS373
82
LM340
IN
OUT
GND
VCC
0.01 UF
100UF
470OUF
VCL
IN4001
TRANSFORMER
8031
78
94
92
96
154
133
22UF
2N3904
10PF
6MHZ
20K 5%
5.6K 2.2K
128
ALE
A
B
C
D
E
F
G
H
Q

ADO-AD7

66
64
74LS240
2A4 2Y4
2A3 2Y3
2A2 2Y2
2A1 2Y1
1A4 1Y4
1A3 1Y3
1A2 1Y2
1A1 1Y1
1G 2G
ADO
AD2
AD4
AD6
AD7
AD5
AD3
AD1
150
SICS
139
BUSSED 10K RES PACK
R R R R R R R R R
1 2 3 4 5 6 7 8 9
VCC
12 POS SWITCH
130
131
132
133
134
135
136
137
138
143
142
141
144
S2CS
LEFT
RIGHT
140
2 POS SWITCH SPRING LOAD
Z
Y
X
J
V

PROBE ASSY
AD590
+VA
IN914
IN914
204
74
210
74C374
Q0
Q1
Q2
Q3
Q4
Q5
Q6
Q7
OE
GND
VCC
D0
D1
D2
D3
D4
D5
D6
D7
A
B
C
78
TEMP
HUMIDITY

IN914
CSCS
256
VCL
258
78L05
IN
OUT
GND
0.1UF
0.1UF
220
ADC0803

ALE

ASCS

ANRD
CS
RD
WR
CLKI
INTR
VI+
VI−
A GND
V REF
D GND
CLKR

INTO
4.99K
1%

221
LM392
OA
INVA
NIA
GND
+V
OB
INVB
NIB
300
5%
62
5%
1.0UF
10K
5%
LM
385
16.5K
1%
2.8K
1%
280
RETURN POWER

METHOD AND APPARATUS FOR AERATION OF STORED GRAIN

BACKGROUND OF THE INVENTION

1. Field of the Invention

This invention relates to a method and apparatus for the controlled aeration of stored grain to prevent spoilage and to achieve a desired grain moisture content. More particularly, the invention relates to a method and apparatus for sensing ambient temperature and relative humidity conditions and selectively aerating grain when suitable or best-available ambient temperature and relative humidity conditions are present for wetting or drying grain or stable maintenance of grain moisture content, as desired by the user.

2. Description of Prior Art

Mold is the major cause of spoilage in stored grain. Mold growth occurs when a moisture and temperature environment suitable for mold is present around the stored kernels. Foreign matter, along with higher temperatures and higher humidities, provide the most favorable environment for mold growth. Clean grain can be stored indefinitely in a storage bin if its moisture and temperature are kept within acceptable limits.

Moisture can be introduced into the air spaces around stored grain (a) by condensation or (b) by the natural respiration of the grain. Condensation can occur when relatively warm, moist air is introduced into the bin and comes into contact with grain that is colder than the air. Condensation more frequently occurs as a result of moisture migration, which happens when natural convection currents within the bin bring warm air from one region of the bin into contact with cooler grain in another region. Crusting and spoiling can result. It is known that the effects of condensation can be minimized by keeping the temperature of the grain at or near the average ambient air temperature.

Natural respiration of stored grain introduces moisture as a function of the temperature and relative humidity of the air surrounding the grain. For a specified temperature and relative humidity combination of the surrounding air, there is a corresponding equilibrium moisture content for the grain; that is, if the air surrounding the grain is kept constant at the specified temperature and relative humidity conditions, the grain will eventually reach the corresponding equilibrium moisture content. Moisture will be given off by the grain kernels when the moisture content of the grain exceeds the equilibrium moisture content supported by the surrounding air conditions; conversely, moisture content of grain will increase when surrounding air conditions will lead to an equilibrium moisture content higher than that present in the grain kernels. In this regard, it should be noted that mold attacks a grain kernel from the outside in; it is the presence of excessive moisture on the outside of the kernel that is to be avoided.

Mold growth on stored grain, then, can be restricted by controlling the moisture content and temperature of the grain. The grain temperature and moisture content determine the allowable storage time that the grain can be kept before it spoils. For that reason (and others), grain prices are adjusted for the moisture content of the grain. Grain which has an excessive moisture content must either be dried or used quickly, and is therefore of less value than grain marketed at standard moisture content levels.

The effects of condensation can be controlled by maintaining the stored grain at a temperature equal (or nearly equal) to the temperature of the surrounding air. The effects of moisture release due to natural respiration could be avoided by excessively drying the grain. Excessive drying of grain, however, is undesirable for several reasons. First, grain that is at or below its equilibrium moisture content for the ambient air conditions, will not spontaneously give off moisture. It requires energy to remove each additional increment of moisture from a kernel as the kernel dries, and overdrying of the grain below its desired market moisture content consumes energy at an increasingly faster rate as the drying progresses, with corresponding higher costs. Secondly, overdrying of grain creates internal stresses within the individual grain kernels, causing cracks and fines, thus lowering the quality of the grain and its market value. Finally, grain is marketed by weight. Overdrying of grain removes more water than is necessary, thereby reducing its total weight. To maximize price, as much moisture should be retained in the kernels as possible, keeping in mind the upper allowable moisture content for safe storage and marketing standards.

Proper storage of grain, then, involves two primary considerations. First, the temperature of the grain should be as close as possible to the average ambient temperature to avoid moisture migration and condensation. Secondly, the moisture content of the grain should be brought to and kept at a predetermined moisture content level that maximizes the weight of the grain at market time, yet is low enough to be stored safely. A secondary, economic consideration is that aeration used to achieve or maintain temperature and moisture content should not be performed more than necessary, as extensive aeration fan operation can lead to high energy costs.

U.S. Pat. No. 3,563,460 to Nine discloses a means for controlling the aeration of stored grain. The Nine device incorporates a plurality of temperature sensors located within the grain, and a comparison device for comparing the monitored temperature to a manually set temperature level. An aeration fan is activated when the grain temperature exceeds the set level. The Nine device, however, requires a continual manual adjustment of the set temperature level in order to maintain the grain temperature reasonably near the actual or average ambient temperature. Moreover, the Nine device does not include any mechanism, manual or automatic, to control aeration of the grain as a function of the relative humidity of the ambient air.

U.S. Pat. No. 4,045,878 to Steffen discloses a method for aerating stored grain wherein the stored grain is exposed to a throughput of atmospheric air if the current atmospheric conditions are optimal, in that they are at or near predetermired historical monthly average atmospheric conditions. Although the method disclosed in the Steffen patent, at least in theory, takes into consideration both temperature and relative humidity, application of the method has several drawbacks. First of all, continuous operator monitoring of ambient air conditions is required. Secondly, aeration of grain is premised on historical monthly temperature averages, and not on the actual current average temperature, which can vary considerably from historical seasonal averages. Finally, long periods of time may elapse without any aeration of the grain at all if the predetermined optimal air conditions are not met.

U.S. Pat. No. 4,522,335, to Kallestad et al., assigned to the assignee of the present application, discloses a method and apparatus for controlled aeration of stored grain to maintain a specified desired grain moisture content. Current ambient temperature and relative humidity conditions are sensed. A running actual average temperature over a specified period is calculated and an equilibrium moisture content for a particular grain type corresponding to the ambient conditions is determined. Aeration is initiated when the current ambient air temperature is within a predetermined acceptable range of the running average ambient temperature and the equilibrium moisture content is within a predetermined acceptable range of the desired grain moisture content. Aeration time is operator-specified at a certain amount per day. If the specified aeration time is not used because ambient conditions are not within acceptable ranges, the unused aeration time is "banked", i.e., stored for later use. The acceptable ranges for aeration are expanded in accordance with the increasing amount of time "banked".

While useful, the invention of U.S. Pat. No. 4,522,335 has certain shortcomings. First, it is necessary for the user to select as an input value the daily aeration time value. While guidelines are available, this has proved to be a difficult decision, because it requires consideration of fan size, bin size, grain volume and other factors. Moreover, once selected, the amount of daily aeration time can only be increased by resetting the value or through the backlog of unused hours built up by "banking" unused time. Second, the invention is designed to maintain a specified moisture content. Thus, it is not well suited for efficiently drying wet grain or rewetting dry grain through selective use of ambient conditions. Third, the expansion of acceptable ranges for aeration is symmetrical around the specified temperature and moisture content values. Because ambient weather conditions in certain climates or seasons tend to be consistently on the dry side or wet side of the acceptable ranges, aeration sometimes leads to undesired drying or wetting the grain, because conditions on either side of the optional relative humidity or grain moisture content values are, in actuality, not encountered equally. Fourth, while the device operates under a rather flexible control system, the variety of weather conditions and climates encountered show that still greater flexibility in adapting to unusual ambient conditions is needed.

A method and device for aeration of stored grain that provides for controlled aeration of stored grain, even when long periods of less than optimum conditions have elapsed, and that addresses the shortcomings of the prior art, would be a decided advantage.

SUMMARY OF THE INVENTION

The problems and shortcomings outlined above are in large measure solved by the method and apparatus for controlled aeration of stored grain in accordance with the present invention. The invention provides for the controlled aeration of stored grain to reduce spoilage and achieve desired moisture content. The method is responsive to ambient temperature, grain temperature and relative humidity conditions, takes into account the actual average temperature over a specified period, and provides for aeration of the stored grain under "next best" criteria when optimal atmospheric conditions are not met over a given period of time. The ranges for "next best" conditions are expanded, if less aeration than desired occurs. The method also includes determining an available amount of aeration time for a specified interval based on the difference between the grain temperature and average ambient temperature. The ranges for "next best" conditions can be expanded symmetrically or assymmetrically, to suit prevailing wet or dry climates. The inventive method also encompasses selective use of ambient conditions to bring grain to a desired moisture content. Apparatus for performing the method is also part of the invention.

DETAILED DESCRIPTION

Figure 1:
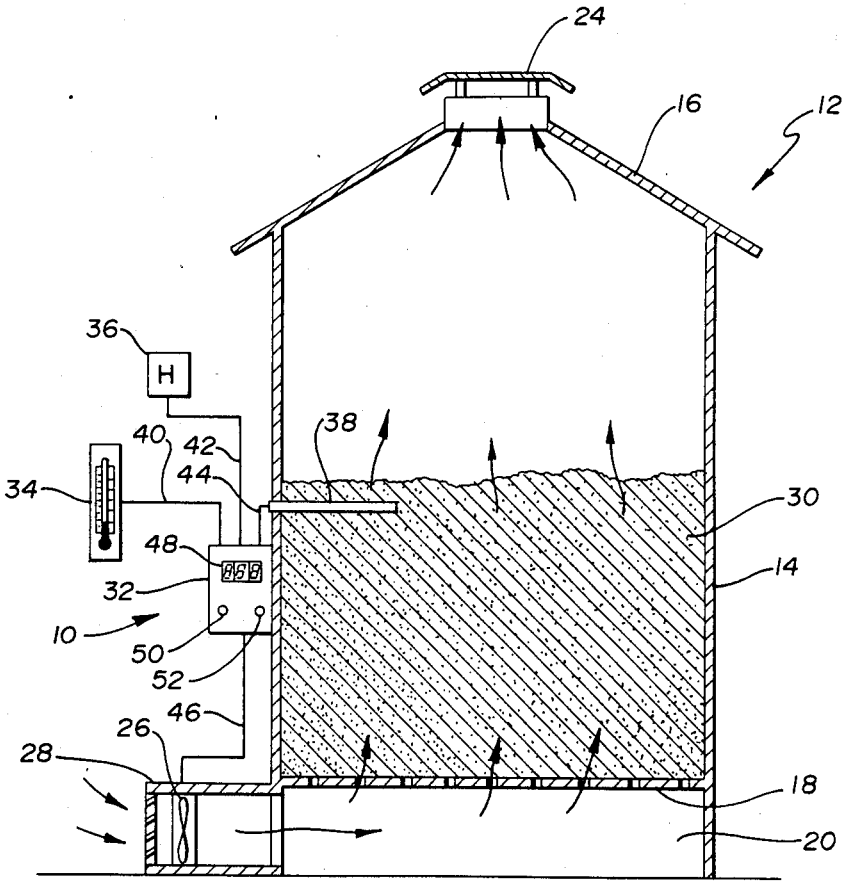
FIG. 1 is a schematic sectional diagram of a grain storage bin with an aeration fan controlled by the present invention.

Referring to FIG. 1, an apparatus 10 for the controlled aeration of stored grain in accordance with the present invention is depicted in conjunction with a grain storage bin 12.

The storage bin 12 includes an upright cylindrical side wall 14 and an apertured, frustoconical roof 16. The bin 12 also includes a raised, perforated floor 18 beneath which is an air-conducting plenum 20. At the uppermost point is a vent 24. An aeration fan 26 is received within conduit 28. Conduit 28 is connected to plenum 20 in air communicating relationship. A quantity of grain 30 is depicted as being stored in the bin 12.

The control apparatus 10 broadly includes a control box 32 attached to the external face of side wall 14, ambient air temperature sensing device 34, ambient relative humidity sensing device 36, and grain temperature sensing probe 38, all connected to control box 32 by respective leads 40, 42, 44. Control lead 46 extends from the control box 32 to the fan 26 for selective operation of the fan 26.

Control box 32 includes a visual display 48, and input controls 50, 52 for operator input of controller functions. Input control 50 allows selection of one of the following modes: MANUAL ON, GRAIN (type), MOISTURE, MODE, PROBE/SCROLL, TIME, RUN and MANUAL OFF. Input control 52 allows selection of either a SELECT operation or a SET operation or neither. These two controls permit the operator to input and/or display system parameters, including grain type, desired grain moisture level, grain control mode, and the desired time of daily fan operation, as will be explained in greater detail below. In addition, control box 32 contains a microprocessor, memory and other circuitry for performing the information processing required by the control system.

The method for controlling the aeration of grain in accordance with the present invention will now be described.

General Method for Aeration

The primary input data for the present method are ambient temperature, ambient relative humidity, grain type, desired grain moisture content and desired time of daily fan operation. It is known that for a given type of grain, the ambient temperature and relative humidity determine an equilibrium moisture content (or EMC), which represents the moisture content that the grain will equalize to if exposed for a prolonged period to that temperature and relative humidity condition. The EMC for a particular type of grain at specified ambient conditions can be determined either from a table of known values, or from a mathematical formulation which approximates the data in such a table. An example of a table appears at page 6 of "Low Temperature & Solar Grain Drying Handbook" published by Midwest Plan Service, Copyright 1980. An example of a mathematical formula useful in determining EMC is the Chung-Pfost equation explained in ASAE paper 76-3520.

Once the EMC at ambient temperature and humidity (in the following all references to humidity shall mean relative humidity unless otherwise stated) conditions is known, this value can be used as part of a determination to aerate or not aerate. In general, aeration under control of the present invention will serve one of three functions. First, the operator may wish to maintain a preselected desired level of moisture content already present (or nearly present) in the grain (maintenance mode). Second, the operator may wish to move grain which is not presently at a desired moisture content toward the desired moisture content, whether that is wetter or drier than current conditions (wetting/drying mode). Third, the system may need to intervene to protect grain that is endangered by internal temperatures rising too far above the average ambient temperature (override mode).

The aeration fan 26 of the grain storage bin 12 can be selectively actuated when ambient conditions or grain temperature indicate the desirability of or the need for aeration. Actuation of the fan 26 will expose the grain 30 to a throughput of air at ambient temperature and humidity conditions, thereby causing the grain 30 to move toward ambient temperature and a moisture content equal to the EMC determined by ambient conditions.

Maintenance Mode

Aeration of stored grain when the ambient conditions support an EMC within predetermined limits of the desired moisture content of the grain will minimize the accumulation of moisture due to natural respiration of the grain kernels. As described above, however, moisture also accumulates within a quantity of stored grain due to the effects of condensation when the grain is exposed to moist air having a warmer temperature than the grain itself. The effects of such condensation are best limited by keeping.the temperature of the stored grain at the temperature of the ambient air. Thus, in the maintenance mode, the invention must take into account both EMC and ambient temperature.

Unfortunately, maintaining grain at ambient temperature frequently cannot be done with precision, because the air temperature changes far more quickly than the temperature of a large mass of stored grain. Moreover, if aeration were initiated whenever grain temperature and ambient temperature differed, significant amounts of energy would be consumed by the aeration fan.

A possible solution is to make use of historical data on average monthly or seasonal temperatures, on the theory that if the grain can be maintained at the average monthly or seasonal temperature, this will avoid wide differences between the temperature of the stored grain and the actual ambient temperature. With this approach, aeration would be used whenever grain temperature and the historical average monthly or seasonal temperature differ. Actual temperatures on a daily, monthly or seasonal basis, however, can vary by large amounts from historical averages. Moreover, historical temperatures vary by geographical region and different data would be required by each region.

The present invention, like U.S. Pat. No. 4,522,335, rejects both the continuous attempt to track ambient temperature and reliance on historical monthly or seasonal averages. Instead, it has been determined that an actual average temperature computed over a specified averaging period (three weeks in the preferred embodiment, but periods of one week to six weeks might be used) produces excellent results in controlling moisture accumulation within stored grain, when used as the center point of a temperature range within which the control system causes grain to be aerated. In particular, a three week running average is maintained by determining the ambient temperature every fifteen minutes in a given twenty-four hour period and averaging the ninety-six temperature readings obtained within the twenty-four hour period to determine a daily average temperature. The three week running average temperature is the average of the most recent twenty-one daily averages.

From the foregoing it can be seen that the basic aeration control philosophy of the maintenance mode of the present invention is to initiate aeration only when (a) ambient temperature and humidity conditions determine an EMC which is at or near the desired grain moisture content, and (b) the ambient temperature is at or near the running average ambient temperature. It is recognized, however, that precisely optimum air temperature and humidity conditions may not occur for long periods and may not persist when they do occur. It is desirable, therefore, to effect aeration of stored grain when the ambient temperature and humidity are within certain predetermined ranges of the optimum conditions. The limit values selected to define these predetermined ranges in the preferred embodiment are described in greater detail below. At this point it suffices to say that the range around the running average temperature could be as large as plus or minus 50° F., while the range around the desired grain moisture content could be as large as plus or minus 10 moisture percentage points around the desired grain moisture content. (Typical ranges will, however, be much narrower than this.)

The fundamental steps for the method of controlled aeration of stored grain in accordance with the maintenance mode of the present invention can be summarized as follows. First, the desired moisture content of the particular type of stored grain is selected. Second, the actual ambient temperature and humidity conditions are measured and the ambient equilibrium moisture content (EMC) is determined therefrom. Third, a running average temperature is calculated. Fourth, the ambient EMC is compared to the desired moisture content of the stored grain, and the actual temperature is compared to the running average temperature. Fifth, it is determined whether there is available aeration time based on operator or system selected daily desired aeration time and whether this aeration time has been used, or not used and therefore accumulated. Finally, a control signal to trigger actuation of the grain storage bin aeration fan is only issued if the ambient EMC is within a predetermined range of the desired grain moisture content, the actual air temperature is within a predetermined range of the running average ambient temperature and there is available aeration time. The manner in which these predetermined ranges are defined is described next. One of the factors affecting the way in which the ranges are defined is the cost of aeration.

Grain within a storage bin will maintain its moisture content and temperature over a period of time due to the semi-isolated environment of the storage bin and the inherent insulative property of the grain mass. There is no need to continuously aerate the grain, even if optimum atmospheric conditions persist. Moreover, energy consumption by an aeration fan can be a significant cost consideration, and it is desirable to operate the fan no more than is necessary. Accordingly, the method and apparatus of the present invention provide for operator or automatic selection of the desired run time of the aeration fan during any twenty-four hour period.

With operator selection, the operator selects and inputs the desired run time of the aeration fan based on the size of the fan and its corresponding air moving capacity and energy consumption rate. While various time choice options might be used, in the preferred embodiment the operator may choose fan operation time in fifteen minute segments, selecting within the range from 15 minutes to twenty hours in fifteen minute increments for a twenty-four hour period.

Alternatively, when a grain temperature sensing probe 38 (or alternative means of sensing grain temperature, such as a temperature sensor exposed to air exhausted during aeration) is used, the operator may utilize an AUTO feature in which the desired fan operation time will be determined automatically based on the deviation between the grain temperature as sensed by the probe 38 and the running average temperature. In general, the greater the deviation, the more corrective aeration is needed. For the preferred embodiment the following table of values is used:

| Deviation from Average Temp. | Daily Aeration Time |
|---|---|
| ±2° | 30 min. |
| ±3° | 45 min. |
| ±4° | 1 hr. |
| ±5° | 1.5 hr. |
| ±6° | 2 hr. |
| ±7° | 3 hr. |
| ±8° | 4 hr. |
| ±9° | 6 hr. |
| ±10° | 8 hr. |
| ±11° | 10 hr. |
| ±12° | 12 hr. |
| ±13° | 14 hr. |
| ±14° | 16 hr. |

(If deviations greater than the above are encountered, then override modes, discussed below, are entered.) As will be seen below, the desired aeration (fan operation) time parameter affects several aspects of the present method.

Because precisely optimal ambient conditions will seldom be encountered, an initial range is defined for both the running average ambient temperature and the desired grain moisture content within which aeration will be initiated if aeration time is available. In the preferred embodiment the initial predetermined range around the running average ambient temperature is ±1° F. For desired grain moisture content, the initial range is defined such that when the ambient air and humidity conditions together determine an EMC within ±0.2 percent of the desired grain moisture content, the EMC condition for aeration will be satisfied. Actual ambient temperature and humidity are sampled every fifteen minutes and if the dual conditions are satisfied, fan operation is initiated for the next fifteen minutes, if the available fan operation time has not been used up.

In addition to the initial ranges, the invention accomodates the possibility that ambient conditions within the initially defined acceptable temperature and EMC ranges may not be met for a long period of time or, if met briefly, will not persist. In that event, the aeration fan will not be actuated at all or will be actuated for only brief periods. This may or may not endanger the grain. The temperature and moisture content of the grain, when the fan is not activated, will in large measure be maintained by the semi-isolated environment of the storage bin. On the other hand, it will be appreciated that respiration of grain kernels and moisture migration may continue, and, without proper aeration, there will be an accumulation of moisture within the stored grain, and a possible change in grain moisture content. Moreover, due to heat released by grain respiration, the grain will not maintain its temperature indefinitely in the absence of aeration. The drift of the grain from optimum moisture content and temperature levels may become larger as the period of insufficient aeration increases. It will also be appreciated that, as the drift from optimum grain moisture content and temperature levels increases, the amount of aeration to restore the grain to optimum conditions correspondingly increases. In order to accomodate such circumstances, the present invention adaptively adjusts its control parameters. First, it adapts by preparing to aerate for longer-than-normal periods when acceptable conditions are finally encountered. Second, it selects a continually widening range of "next best", acceptable ambient temperature and humidity conditions so that, even when conditions within predetermined, initial optimum ranges are not met, the grain within the storage bin will receive some aeration. This occurs as follows.

As set forth above, the desired run time of the aeration fan during any given twenty-four hour period is either selected by the grain bin operator or the system with its AUTO feature. If the ambient conditions in a twenty-four hour period do not fall within the predetermined, initial ranges and available aeration time is not fully used, then the amount of selected aeration left unused at the end of a twenty-four hour period will be "banked" or stored. For example, if no time has previously been "banked" and acceptable conditions are not met at all for two days, but are met on the third day, the run time available for the aeration fan on the third day will be three times the desired run time limit selected by the operator for a twenty-four hour period or the total of the run times selected by the AUTO feature for the first, second and third days. The "banking" of unused run time automatically accounts for the facts that the grain may drift further from desired temperature and moisture content levels as the time between aeration increases, and that more run time is required to bring the grain back to acceptable levels as the margin of drift from optimum levels increases.

The method of modifying initial ranges to select "next best" conditions for aeration utilizes the "banked" aeration time parameter. In particular, as the banked aeration time increases, the predetermined, initial ranges considered acceptable for aeration are expanded, so that the backlog of aeration time has a greater chance of being used. In the preferred embodiment the ranges are increased somewhat differently in three variations of the storage mode. The values for STORAGE 1 mode are shown in the following table:

| "Banked" Fan Time | Temperature Range | EMC Range |
|---|---|---|
| 0–4 hrs. | ±1° F. | ±0.2% |
| 4.25–8 hrs. | ±1° F. | ±0.3% |
| 8.25–12 hrs. | ±2° F. | ±0.4% |
| 12.25–16 hrs. | ±2° F. | ±0.5% |
| 16.25–20 hrs. | ±3° F. | ±0.6% |
| 20.25–24 hrs. | ±3° F. | ±0.7% |
| greater than 24 | ±1.0° F. increase for each additional 8 hrs. | ±0.1% increase for each additional 4 hrs. |

As an alternative to the above approach to expanding the ranges of acceptable ambient conditions, two other expansion methods have been found useful. The first of these (STORAGE 2 mode) can be selected for storage mode operation of the invention in climates or seasons known to be predominantly dry rather than wet. In these climates or seasons a symmetrically expanded range would lead to drying of the grain because, as the range is expanded, more dry weather is encountered that is considered acceptable for aeration than wet weather. Aeration in this drier weather tends to push the grain toward greater dryness. Wet weather, being seldom encountered, does not counterblance the increased aeration during dry weather. The remedy for this is found in a non-symmetrical expansion of the range around the desired EMC. In particular, the above table is modified by holding the lower boundary of the desired EMC range at −0.2%, while the upper boundary increases as shown in the table. For example, for 4.25–8 hrs., the EMC range is −0.2% to +0.3%.

A similar expansion method is defined for predominantly wet weather (STORAGE 3 mode). To avoid excess wetting, the range is non-symmetrically expanded to include a broader range of ambient conditions on the dry side of the desired EMC. In particular, the above table is modified by holding the upper boundary of the desired EMC range at +0.2%, while the lower boundary increases as shown in the table. For example, for 8.25–12 hrs., the EMC range is −0.4% to +0.2%.

It will be appreciated that, as more time is "banked" in STORAGE 1, STORAGE 2 or STORAGE 3 modes, and the ranges of acceptable average temperature and EMC levels are accordingly increased, it becomes more and more likely that the aeration fan will be actuated. The time "banked" will then be decreased, time segment for time segment, once the fan is actually operated. As the "banked" time decreases, the ranges of acceptable temperature and EMC levels will accordingly be narrowed, in reverse sequence from the range widening progression.

An additional feature of the inventive method in the storage mode is a limit on the value of the running average temperature used as one of the aeration criteria. In the preferred embodiment, in order to avoid excessive cooling or heating of the stored grain during extreme weather, the running average temperature around which the range of acceptable ambient temperature is defined is never allowed to go below 20° F. or above 65° F. That is, the available range of values is truncated so that all values below 20° F. are taken to be 20° F. and all values above 65° F. are taken to be 65° F. These upper and lower limits may be varied for installations in different geographic areas.

Wetting/Drying Modes

The storage mode previously discussed is appropriate for maintaining grain at or near a desired moisture content. It is not, however, efficient for bringing grain which is far from a desired moisture content to that level. Because grain is often placed into storage at a moisture content higher than desired and because various difficult weather conditions or storage circumstances can cause grain to deviate from a desired moisture content by being either too wet or too dry, the present invention includes wetting and drying modes that are designed to use aeration at ambient conditions to achieve the desired moisture content.

If the operator desires to rewet dry grain, the invention offers five rewetting modes (REWETTING 1–5). If the operator desires to dry wet grain, the invention offers five drying modes (DRYING 1–5). In each of these, the user selects as an input value to the system the desired moisture content. As in the storage mode, ambient temperature and humidity are measured, a running average temperature is calculated and an EMC based on ambient temperature and humidity is determined.

Aeration is initiated in the rewetting modes as follows:

REWETTING 1 —whenever EMC exceeds (is wetter than) the desired moisture content.

REWETTING 2—whenever EMC exceeds the desired moisture content and ambient temperature exceeds 40° F.

REWETTING 3 —whenever EMC exceeds the desired moisture content and ambient temperature is both above 40° F. and within ±15° F. of average temperature.

REWETTING 4—whenever EMC exceeds the desired moisture content and ambient temperature is both above 40° F. and wthin ±10° F. of average temperature.

REWETTING 5—whenever EMC exceeds the desired moisture content and ambient temperature is both above 40° F. and within ±5° F. of average temperature. As can be seen, the progression is from a mode in which aeration to cause rewetting will occur whenever possible (REWETTING 1), to more restrictive modes. Common to all remaining modes is a predetermined minimum temperature (in the preferred embodiment 40° F.) below which no aeration occurs. This is because air at lower temperatures carries very little moisture. Thus, aeration at such temperatures utilizes energy inefficiently for rewetting purposes.

Aeration is initiated in the drying modes as follows:

DRYING 1—whenever EMC is lower (drier) than the desired moisture content.

DRYING 2—whenever EMC is lower than the desired moisture content and ambient temperature exceeds 40° F.

DRYING 3—whenever EMC is lower than the desired moisture content and ambient temperature is both above 40° F. and within ±15° F. of average temperature.

DRYING 4—whenever EMC is lower than the desired mqisture content and ambient temperature is both above 40° F. and within ±10° F. of average temperature.

DRYING 5—whenever EMC is lower than the desired moisture content and ambient temperature is both above 40° F. and within ±5° F. of average temperature.

As with rewetting modes, the progression is from a mode in which aeration to cause drying will occur whenever possible (DRYING 1), to more restrictive modes. Common to all remaining modes is a minimum temperature (in the preferred embodiment 40° F.) below which no aeration occurs, because it is not accomplished efficiently with the small amounts of moisture that can be carried by cold air.

In none of the rewetting or drying modes is there any limit on aeration (fan operation) time nor is there a preset daily aeration time or "banking" of unused aeration time. The fan for aeration simply operates whenever predetermined ambient conditions are met.

Closely related to the previously described rewetting and drying modes are two "special" modes. In the first of these, SPECIAL 1, the operator selects both a desired grain moisture content and the acceptability ranges for aeration, similar to the ranges automatically determined by the invention in the storage modes. The default values for the acceptability ranges are ±5° F. around average temperature and ±1% around desired moisture content. These values can be reset by the operator to any desired set of symmetrical limits (within specified broad ranges). Fan operation time is not predetermined, and aeration will occur whenever ambient conditions fall within the specified acceptability ranges. The ranges do not expand or narrow unless reset by the operator.

The second "special" mode, SPECIAL 2, is identical to SPECIAL 1, except that in addition to selecting desired moisture content and symmetrical ranges, the operator also selects daily aeration time. Aeration then occurs whenever ambient conditions fall within the specified acceptability ranges and aeration time is available. Unused aeration time is "banked" for later use as in the storage modes, but the acceptability ranges do not expand or narrow based on a backlog of "banked" aeration time.

Override Modes

Maintaining stored grain at or bringing stored grain to a desired moisture content and maintaining grain at a temperature close to the running average air temperature are the primary factors to be considered in proper handling of stored grain. It will be appreciated, however, that excessively high or low grain temperatures indicate conditions which threaten grain and are to be avoided. Moreover, to reduce moisture migration and condensation within the grain, it is essential that grain temperatures be relatively uniform throughout the storage bin. The method in accordance with the present invention therefore provides for several "override" conditions that take precedence over aeration controlled solely as a function of ambient temperature and EMC in the manner described above, so as to avoid or alleviate extreme, or nonuniform grain temperatures.

The simplest of the available overrides is manual override, effected by user selection of manual control of fan. To do this the user simply selects the MANUAL ON (aeration is initiated) or the MANUAL OFF (aeration ceases) mode and thus runs the aeration fans at his or her discretion. Also included in the invention are several automatic override features.

The first override feature requires the presence of grain temperature probe 38 and takes effect when the grain temperature is not within ±8° F. of the running average temperature. In this override mode (which functions in all three storage modes), the desired aeration fan operation time as set by the operator is considered to be doubled (up to a maximum of 20 hours per day) for purposes of running the aeration fans and/or "banking" unused aeration time. (This override does not work when the AUTO function is used to select fan operation time.) Thus, mc're aeration time becomes available at twice the selected rate and, if available aeration time is not used, aeration becomes more likely to occur due to the increase in banked aeration time causing faster broadening of the acceptable temperature and EMC ranges for aeration. This override remains in effect until the grain temperature returns to within ±4° F. of the running average temperature.

The second automatic override feature takes into consideration that the grain temperature (as measured by probe 38) should never exceed the running average ambient temperature by a large margin. The method of grain aeration in accordance with this override calls for the aeration of the grain regardless of other conditions when (a) the grain temperature exceeds the running average ambient temperature by greater than 15° F., and (b) the actual ambient air temperature is at least 5° F. cooler than the grain temperature, and (c) the actual ambient humidity is not greater than 90 percent. Aeration pursuant to this override mode will continue until one of these conditions is no longer met. This override mode functions in all storage and rewetting/drying modes but not in the SPECIAL 1 or SPECIAL 2 modes.

The third automatic override feature is similar to the second override feature described above. With this override (which functions in all storage and rewetting/drying modes), aeration of the grain occurs regardless of other conditions when (a) the grain temperature exceeds the running average temperature by 30° F. and (b) the actual ambient air temperature is at least 5° F. cooler than the grain temperature. Humidity does not influence this override. This override remains in effect until one of these conditions is no longer present.

Electronic Circuitry and Operator Inputs

Figure 2:
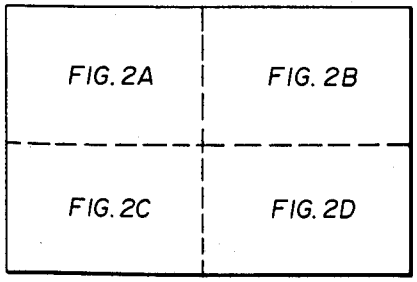
FIG. 2 which is composed of FIGS. 2A–2D joined as shown in FIG. 2, is an electrical schematic for the digital circuitry of an apparatus embodying the present invention.
Figure 3:
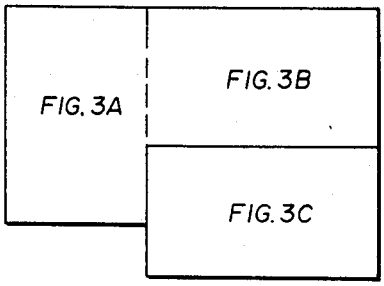
FIG. 3 which is composed of FIGS. 3A–3C joined as shown in FIG. 3, is an electrical schematic for the analog circuitry of an apparatus embodying the present invention.
Figures 2A, 3A:
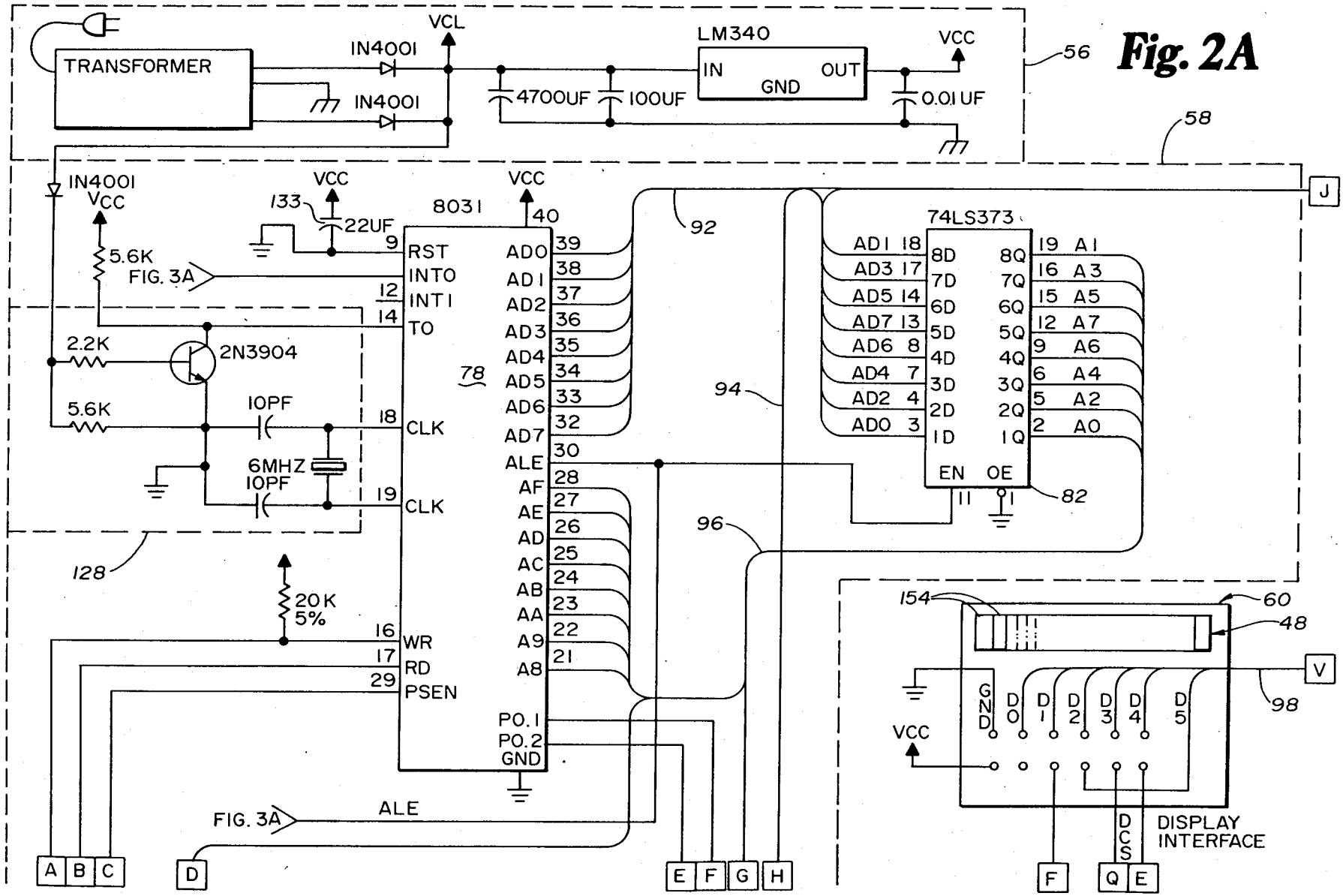
Figures 2B, 3B:
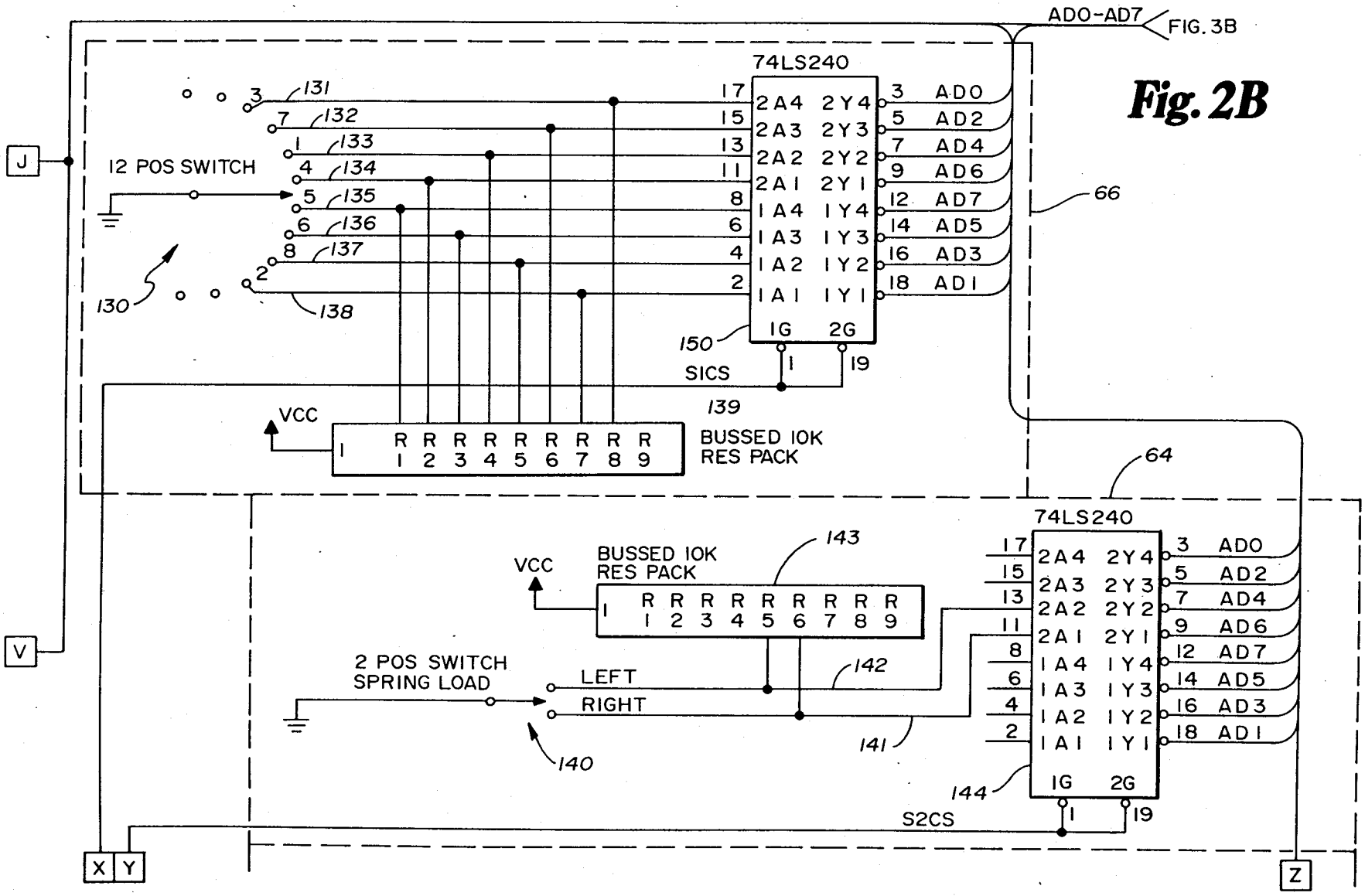
Figure 2C:
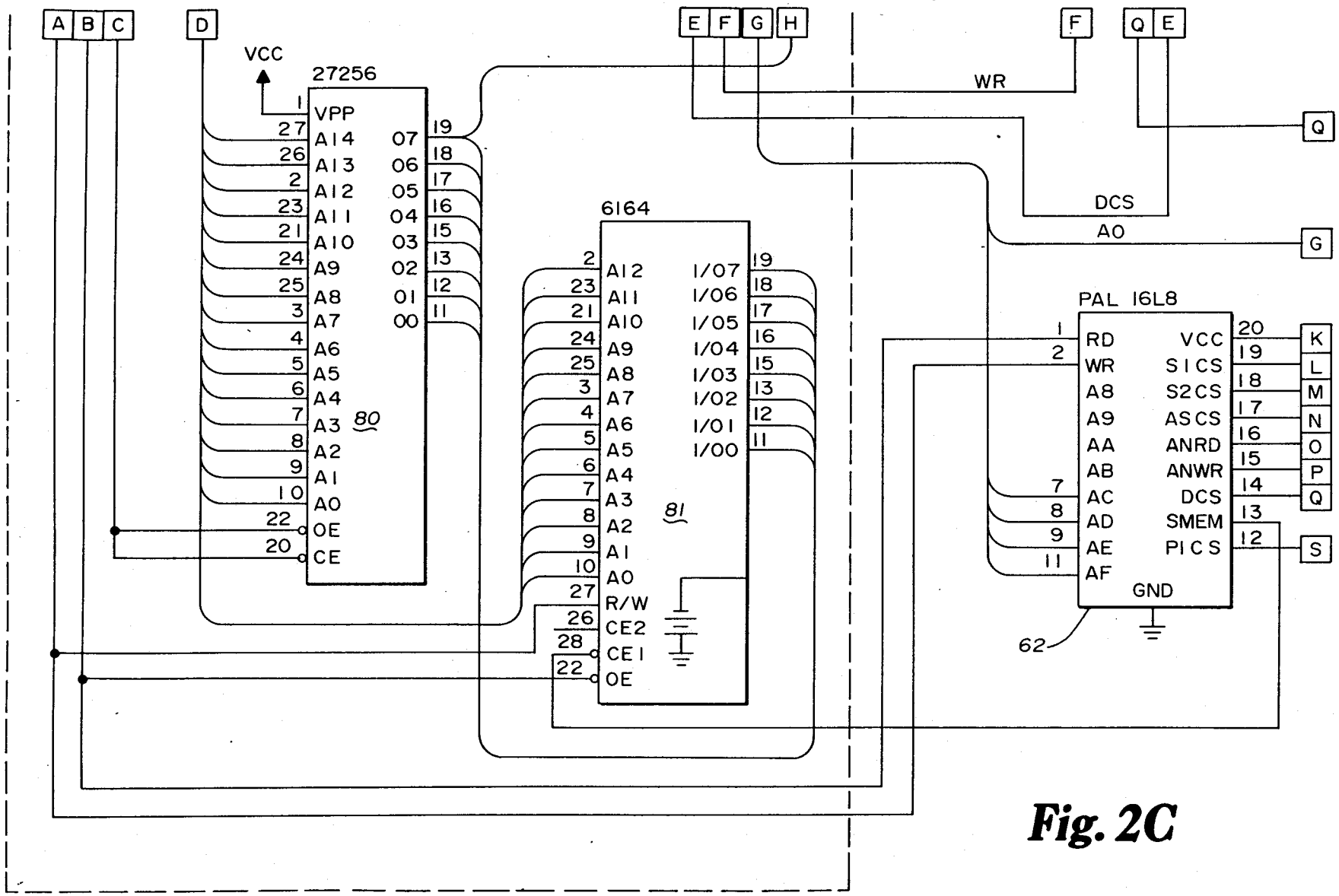
Figure 2D:
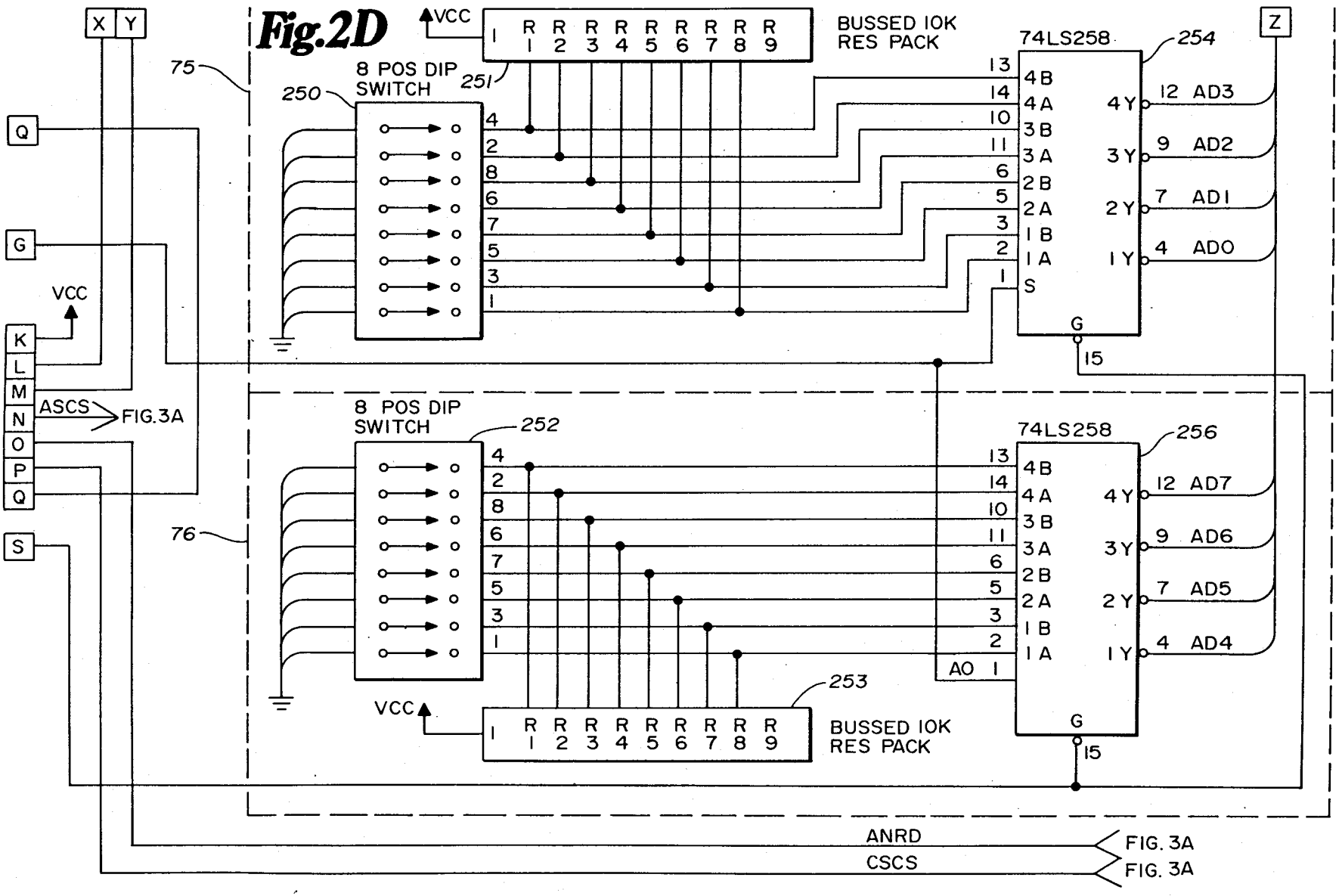
Figures 2A, 2D, 3A:
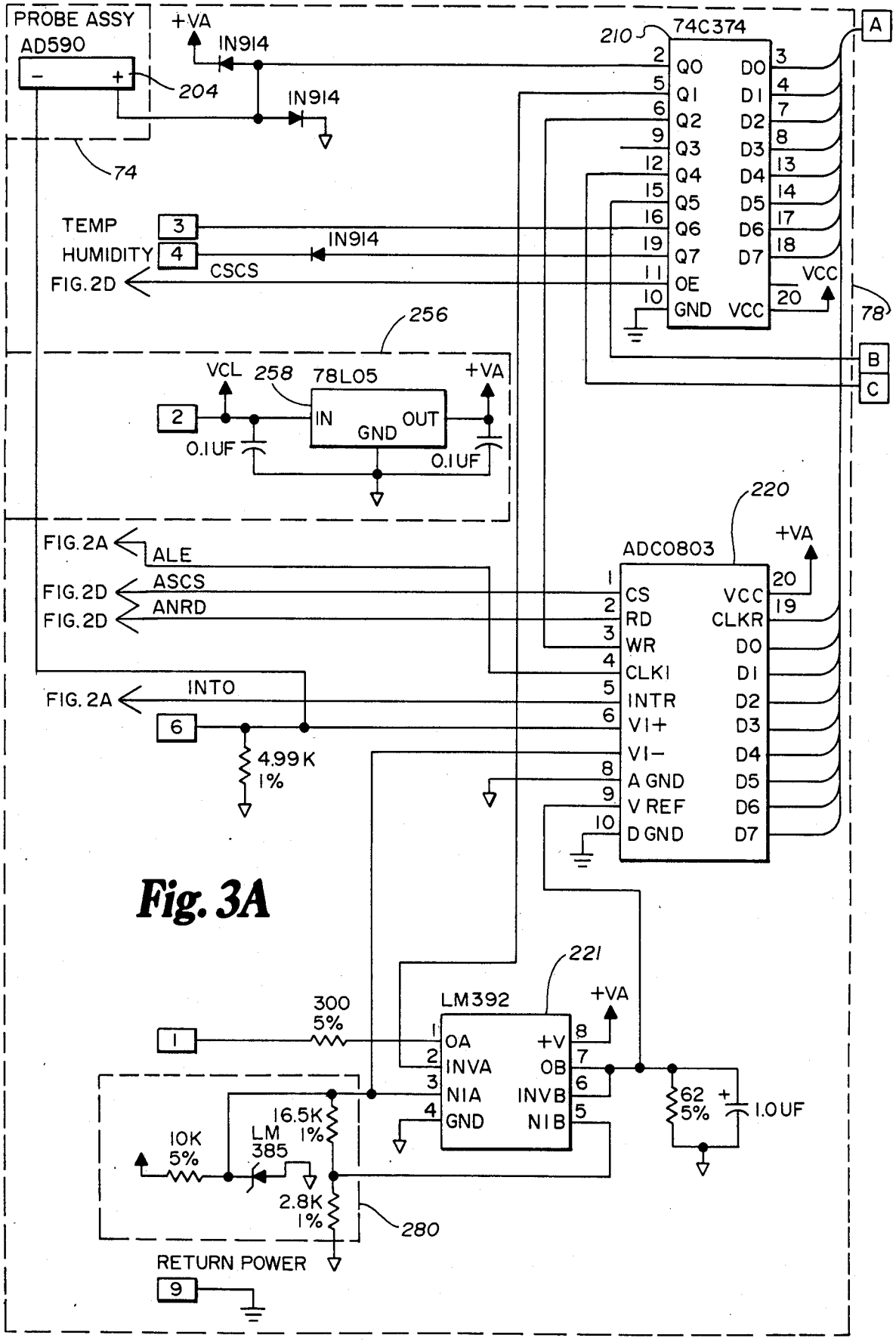
Figure 3B:
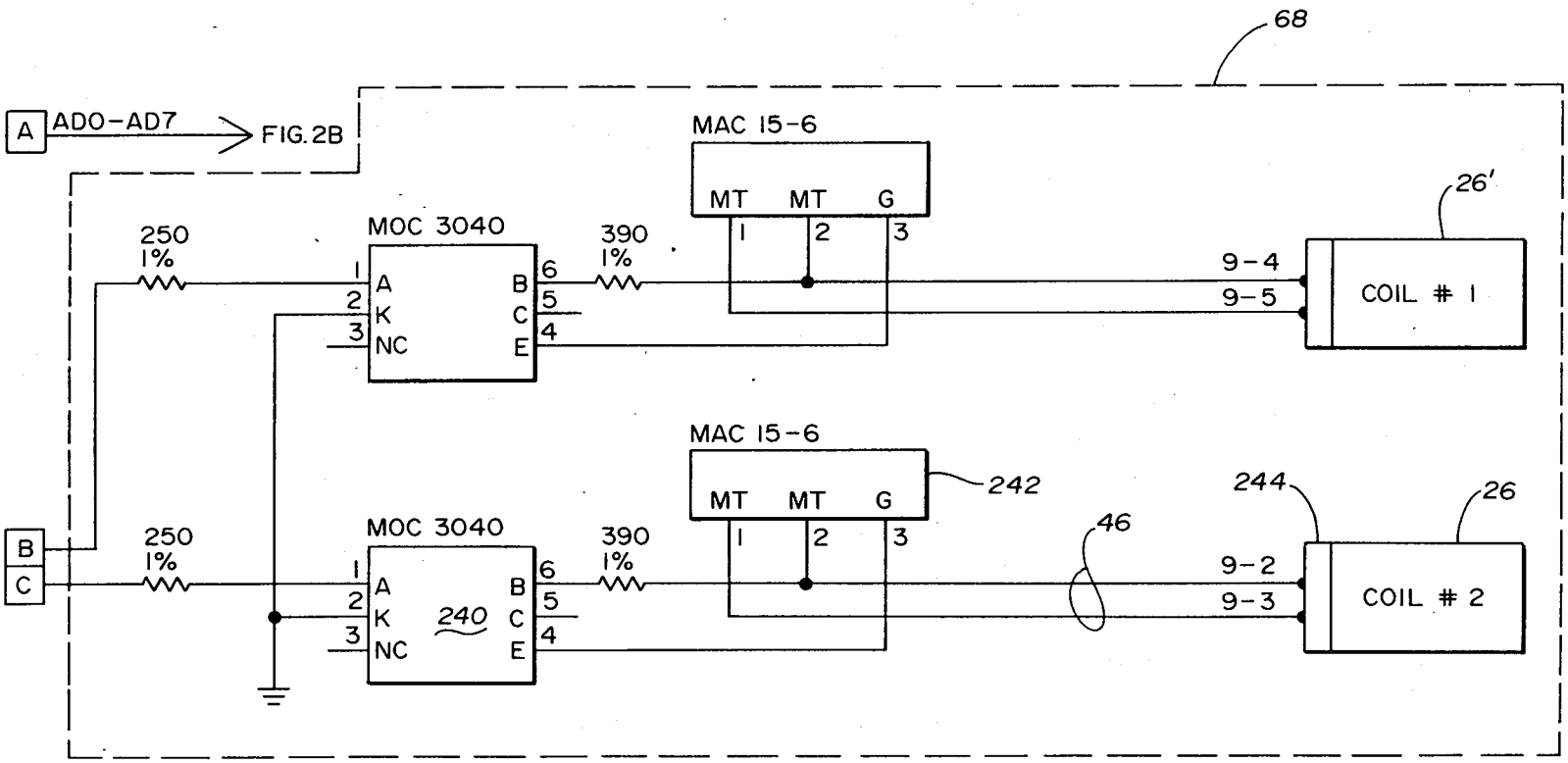
Figure 3C:
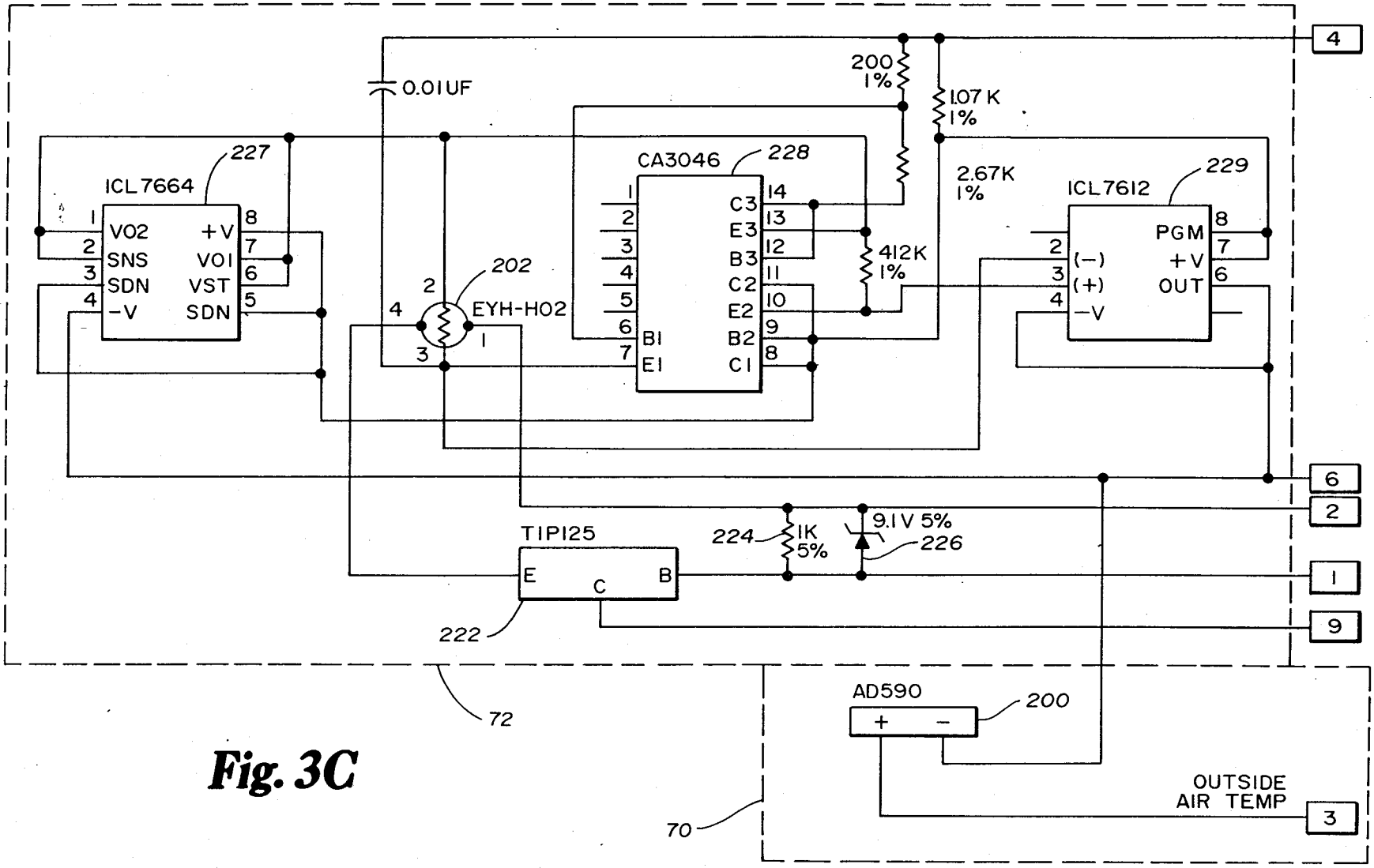

Referring now to FIGS. 2 and 3, the electronic circuitry of the apparatus in accordance with the present invention will be described. In these figures individual chips are identified by standard model numbers. Numerals in the figures appearing with the integrated circuit chips indicate actual pin numbers for the indicated types of integrated circuit chips. Reference numbers on electrical lines interconnecting the various integrated circuit chips will assume reference to the drawings for the proper pin connections. FIG. 2 shows digital circuitry, while FIG. 3 shows primarily analog and sensor circuitry.

The apparatus 10 for controlling the storage of grain broadly includes a digital board power supply 56, a processing unit 58, a display module 60 (associated with visual display 48), an I/O decoder circuit 62 for the processing unit 58, set/select switch circuit 64, mode selection switch circuit 66, fan actuating circuit 68, analog board power supply 256, air temperature, air humidity and grain temperature sensing modules 70, 72, 74, respectively, sensor data processing module 78 and a pair of 8-position data input switch circuits 75, 76.

The power supply 56 receives standard line AC supply, reduces its voltage by a transformer to 12.6 volts, rectifies and smoothes it, regulates it using an LM340 power regulator (available from: National Semiconductor), and provides DC output voltage of 5 volts (VCC). Also available is the square-wave output voltage after rectification (VCL), for proper operation of the clock circuitry 128 and supply to analog board power supply 256.

The processing unit 58 includes a microprocessor (CPU) 78, a first memory unit 80 (EPROM), a second memory unit 81 (battery backed-up static RAM), and latch 82. The microprocessor is advantageously a type 8031 unit (Intel). The EPROM memory unit 80 is advantageously a type 27256 chip (Intel) with 256K bit capacity, while the static RAM memory unit is advantageously a 6164 chip (Harris) with 8k by 8 bit capacity. The latch 82 is advantageously a type 74LS273 chip (Intel).

Lines AD0 through AD7 and A8 through AF comprise addressing lines interconnecting the CPU 78 with EPROM 80 and RAM 81. Lines AD0 through AD7 also serve as data lines for bringing data to the CPU 78 (via the microprocessor bus 92 and data bus 94) from the EPROM 80 or the RAM 81. The latch 82 is used to place the data from lines AD0 through AD7 of the microprocessor 78 on the system address bus 96 under control of the ALE (address latch enable) line. Basically, the CPU 78 addresses the EPROM 80 to fetch program instructions for execution. The CPU 78 also reads data from or writes data into the RAM 81. Data to be displayed on the display module 60 are communicated on microprocessor bus 92.

Clock circuitry 128 connected to VCL provides a time reference and clocking pulses at 6 MHz for operation of the CPU 78. Supply voltage (VCC) at 5 volts, is provided to the CPU 78 at pin 40. Capacitor 133 connected to VCC provides a power-up reset pulse to CPU 78 at pin 9.

A PAL 16L8 (Monolithic Memories) programmable array logic chip 62 is connected to the AC–AF addressing lines and to the write (WR) and read (RD) lines of the microprocessor 78. The PAL 16L8 chip 62 is a customizable device which is programmed in the present invention to decode address information from the microprocessor 78 for selecting the different IO points and devices that provide operating parameters to or receive data from the processing unit 58. Addresses provided on lines AC–AF cause various IO points and devices to be selected. Selection of the S1CS (switch 1 chip select) line connected to the mode selection switch circuit 66 causes the output from that switch circuit to be placed on the microprocessor bus 92. Selection of the S2CS (switch 2 chip select) line connected to the set/-select switch circuit 64 causes the output from that switch circuit to be placed on the microprocessor bus 92. Selection of the ANRD (analog read) line connected to the sensor data processing module 78 causes the output of that module to be placed on the microprocessor bus 92. Selection of the ANWR/CSCS (current source chip selector) line, also connected to the sensor data processing module 78, signals that circuitry that it is about to receive data from the microprocessor bus 92. Selection of the DCS (display chip select) line connected to the display 60, signals that the display 60 is to receive data on the display bus 98 via the microprocessor bus 92. Selection of the SMEM (static memory) line connected to the RAM 81 causes the output of RAM 81, at I/O0–I/O7 to be placed on the data bus 94. Selection of the PICS line connected to the pair of 8-position switch circuits 75, 76 causes the data from those switch circuits to be placed on the microprocessor bus 92. In sum, by programming the I/O decoder 62 to select various lines on its right side based on the inputs received at its left side under coordination of the microprocessor the various I/O devices associated with the processing unit 58 can be individually selected.

The set/select switch circuit 64 and the mode selection switch circuit 66 are, as noted above, both connected to lines AD0–AD7 of the microprocessor 78. When the I/O decoder 62 selects line S2CS, one of three switch states will be communicated to the processing unit 58. The two position spring-loaded switch 140 has a SET position, a SELECT position and a center off position into which it is spring-biased. The output lines 141, 142, which are normally pulled high by resistors in the resistor pack 143, are grounded when SET or SELECT is chosen by the operator. This changes the state of line 2A1 (SET) or 2A2 (SELECT) and, via the I/O line buffer driver 144, places data on the microprocessor bus 92. The I/O line buffer driver 144 is a 74LS240 (National Semiconductor) chip. Functionally speaking, the SELECT state directs the microprocessor to scroll through on the display 60 whatever options (if any) are associated with the mode switch circuit 66 (discussed next). Scrolling ceases when the switch 140 returns to its center off position. The SET state is used to select for input to the processing unit 58 the current value on the display 60 when the scrolling ceases and to reach submenus.

The mode selection switch circuit 66 includes a 12-position switch 130. Eight positions of this are used to permit selection of one of the following modes:

GRAIN—with SELECT, causes grain types to be scrolled through on the display 48, with the current operator-selected type being designated by an asterisk.

MOISTURE—with SELECT, causes desired grain moisture content values from 8% to 18% to be scrolled through in 0.1% increments, with the current operator-selected value being designated by an asterisk.

MODE—with SELECT, causes the 15 operational modes (STORAGE 1–3, REWETTING 1–5, DRYING 1–5, SPECIAL 1–2) to be scrolled through, with the current operator selected mode being designated by an asterisk.

PROBE/SCROLL—with SELECT, causes PROBE ON and PROBE OFF to be displayed with the current operator-selected choice designated by an asterisk, followed by SCROLL SPEED and SCROLL SELECT. SCROLL SPEED state is used to reach a submenu which allows selection of scrolling speed. SCROLL SELECT state is used to reach a submenu to select for display such system parameters as air temperature, air humidity, aeration time, backlog (available aeration time), etc. All selected variables are continuously and sequentially displayed when the system is in MANUAL ON, MANUAL OFF or RUN modes. Current operator-selected values are designated with an asterisk.

TIME—with SELECT, causes a daily aeration time menu of from 0.25 to 20 hours to be scrolled through in 0.25 hour increments with the current operator-selected value designated by an asterisk. Also scrolled through is the AUTO function described above for automatic selection of aeration time based on temperature criteria.

RUN—causes the system to begin to run under the operational mode and other parameters selected.

MANUAL OFF—terminates aeration manually.

As with the switch 140, the switch lines 131–138 are pulled high by resistors in a resistor pack 139 and are grounded when selected at the switch 130. This causes the switch state data to be placed on the microprocessor bus 92 via the I/O line buffer driver 150, a 74LS240 (National Semiconductor) chip.

Functionally speaking, the mode switch circuit 66 in conjunction with the set/select switch circuit 64 permits the operator to display and select the basic operational modes and parameters. As the menus of parameters are displayed, the set/select switch 64 can be used to choose parameters for input to the processing unit 58.

Display module 60 includes sixteen identical fifteen-segment displays 154. The fifteen-segment displays may advantageously be LED-type displays drawing approximately 160 milliamps for full illumination (Refac Electronics). They are driven in a refreshing cycle by an ICM7243BCPL multiplexed display driver chip (not shown) (General Electric). Additional conventional circuitry including current source and sink elements is used as prescribed by General Electric to raise current levels to provide full illumination.

Air temperature, air humidity and grain temperature are sensed by sensing modules 70, 72, 74, respectively, under the control of the processing unit 58 via the sensor data processing module 78 communicating on the microprocessor data bus 92. For stability and consistency the components of this circuitry are all supplied with VA provided by the analog board power supply 256. This power supply receives the voltage VCL from an intermediate stage of the digital board power supply 56, smoothing and regulating it by means of a 78L05 voltage regulator 258 and associated capacitors.

The air temperature sensing module 70 is an AD590 (Analog Devices) linear temperature sensor 200 whose analog output is an electrical current value proportional to absolute temperature. The supply current to temperature sensor 200 is delivered at Q6 of the 74C374 (National Semiconductor) eight-bit latch 210, which serves as a current source. The grain temperature sensing module 74 (contained in the probe 38) is also an AD590 linear temperature sensor 204. Its supply current is delivered at Q0 of the eight-bit latch 210. The other circuit lead for each of the sensors 202, 204 is connected to the VI+ line of an ADC0803 (National Semiconductor) analog to digital (A-D) converter 220, permitting the current value delivered to the A-D converter 220 to be output as a digital value at lines D0–D7 connected to the microprocessor bus 92. Clock pulses to step the A-D converter 220 through its conversion sequence are delivered to CLKI line by the ALE line from the microprocessor 78.

The humidity sensing module 72 comprises an EYH-HO2 (Panasonic) ceramic humidity sensor 202, which has an associated heating element for purging moisture or foreign material to prepare for a new reading. The heating element in the sensor 202 is driven by a heating circuit consisting of power transistor TIP 125 (Fairchild) 222, a resistance 224 and a zener diode 226. These elements are connected to each other as shown in the drawings and to supply voltage VCL and a return power ground point. The base of the transistor 222 is connected to the OA line of an LM392 (National Semiconductor) dual linear chip 221, containing one operational amplifier and one voltage comparator. The comparator section is used as a driver for the humidity sensor heating circuit.

Also part of the humidity sensing circuit are an ICL7664 (Maxxum) micropower programmable negative voltage regulator 227, a CA3046 (RCA) NPN transistor array 228 and an ICL 7612 (Maxxum) micropower CMOS operational amplifier 229 with various associated resistors as shown in the drawings. The voltage regulator 227 serves as a voltage reference, which in combination with the other components performs a logarithmic compression of the current output of the humidity sensor 202 to precondition it for processing by the A-D converter 220. Current to the humidity sensing module is provided at Q7 of the eight-bit latch 210 and output current is delivered to the VI+ line of the A-D converter 220.

In general, signals on the microprocessor bus 92 together with the CSCS signal on the OE line of eight-bit latch 210 cause current to be supplied by the latch 210 on a selected line directed to the air temperature sensing module 70, the grain temperature sensing module 74 or the humidity sensing module 72. The resulting current value indicative of the sensed condition is delivered to the A-D converter 220 for conversion to a digital value. The operational amplifier section of LM392 chip 221 is used to buffer the span reference for the A-D converter 220. The LM385 (National Semiconductor) zener diode circuitry 280 connected to the NIA and NIB lines of the LM392 chip 221 provides reference voltages. Output from the A-D converter 220 appears at D0–D7 upon activation of the ANRD line connected to the RD line of the A-D converter 220.

Aeration fan control occurs as a result of signals supplied on the microprocessor data bus 92 to the eight-bit latch 210. A first fan is controlled by the output at Q4. A second fan is controlled by the output at Q5. As the fan actuation circuitry for each output is identical, only one will be described. Connected to Q4 is an MOC 3040 (Motorola) opto-isolator 240, which, in turn, is connected to an MAC 15-6 (Motorola) triac 242. The triac 242 via control lead 46 drives a relay 244 that controls power to the fan 26. Second fan 26', if present in an installation, would be controlled in like manner.

Manually actuated 8-position switches 250, 252 in switch circuits 75 and 76 provide for operator control of certain functions of the CPU 78. In particular, contact 1 of switch 250 provides for the enable/disable of a four-second delay between turn-on of multiple fans, to avoid large current surges associated with startup of the fans. Contact 2 of switch 250 provides selection of temperature displays in either Fahrenheit or Celsius. For reset purposes, contact 3 of switch 250 allows accumulated run times to be set to zero; contact 5 allows "banked" aeration time to be set to zero. Contact 4 of switch 250 in conjunction with the set/select switch circuit 64 permits average ambient temperature to be set to an initial value. Contacts 6 and 7 of switch 250 permit setting of the upper and lower limits, respectively, for the value that the average ambient temperature can assume. Finally, contact 8 of switch 250 allows for self-diagnosis of the display and the settings of switches 250, 252.

Switch 252 has eight contacts, but only five are presently used for operator control. Contact 1 of switch 252 permits designation of supply power as 50 cycles instead of .60 cycles. Contacts 2 and 3 of switch 252 allow alteration of the operating ranges for the SPECIAL 1 and SPECIAL 2 modes. Contact 2 controls average temperature range, while contact 3 controls desired moisture content range. Contact 7 of switch 252 allows for a speed-up mode in which everything that normally takes one minute occurs in one second. Contact 8 of switch 252 allows humidity sensors to be changed by programming the new "personality" figures of the replacement sensor.

Resistor packs 251, 253 associated with the switches 250, 252, respectively, hold the various lines high until grounded by contact closure. Only four bits from each of switches 250 and 252 is placed on the microprocessor bus 92 at a time. This selection is performed by I/O line buffers 254, 256 under control of the PICS line from the I/O decoder 62. The A0 line from the system address bus is used to cause the selected data to be placed on the microprocessor bus 92.

In the preferred enbodiment PLM 152 language source code contained within EPROM 80 goueras operation of CPU 78. This source code specifies the computational and algorithmic details for the method of the present invention.

While the preferred embodiment of the invention has been illustrated and described, it is to be understood that the invention is not limited to the precise method and apparatus herein disclosed, and the right is reserved to all variations coming within the scope of the appended claims. For example, it will be clear that the invention will work in storage bins with a variety of shapes and will work as well with duct-type air delivery systems or with fan arrangements that pull air down through the grain rather than by pushing it up through a plenum. Likewise it is clear that the method could be performed by other comparable circuitry or information processing means. It will further be clear that the invention could be implemented by substituting a desired or target humidity value for the desired grain moisture content and using a range around the desired humidity value, determined and adapted in a similar manner as the range around desired or target grain moisture content. (This is because equilibrium moisture content is determined by a temperature and humidity value.)

What is claimed as new and desired to be protected by Letters Patent is:

1. A method for controlling aeration of stored grain which is to be maintained at or near a specified desired grain moisture content comprising the steps of:

measuring the current ambient air temperature;

measuring the current ambient air relative humidity level;

measuring the temperature of the grain;

determining the equilibrium moisture content corresponding to said current ambient temperature and relative humidity readings;

determining a running average ambient temperature from a plurality of time-spaced measurements of ambient air temperature taken over a specified period of time;

determining an available amount of aeration time for a specified interval based on the difference tetween the grain temperature and the running average ambient temperature;

calculating available aeration time by summing said available amount of aeration time for each specified interval and subtracting therefrom an amount equal to time spent performing aeration; and aerating said grain when said current ambient air temperature is within a predetermined acceptable range of said running average ambient temperature, said equilibrium moisture content is within a predetermined acceptable range of the desired grain moisture content and said available aeration time is not equal to zero.

2. The method as claimed in claim 1 including the step of widening the acceptable range around said running average ambient temperature when the available aeration time is greater than a predetermined amount.

3. The method as claimed in claim 2, including the step of widening the acceptable range around said desired grain moisture content when the available aeration time is greater than a predetermined amount.

4. The method as claimed in claim 1, including the step of widening the acceptable range around said desired grain moisture content when the available aeration time is greater than a predetermined amount.

5. The method as claimed in claim 1, said predetermined acceptable temperature range being within plus or minus 50° F. around said running average ambient temperature.

6. The method as claimed in claim 1, said predetermined acceptable temperature range being within plus or minus 1° F. around said running average ambient temperature.

7. The method as claimed in claim 1, said acceptable range around desired grain moisture content being within plus or minus 10 grain moisture percentage points of the desired grain moisture content.

8. The method as claimed in claim 1, said acceptable range around said desired grain moisture content being within plus or minus 0.2 grain moisture percentage points around said desired grain moisture content.

9. The method as claimed in claim 1 wherein said step of aerating comprises actuation of an aeration fan.

10. The method as recited in claim 1 wherein the step of determining an available amount of aeration time for a specified period involves increasing the available amount of aeration time as the difference between the grain temperature and the running average ambient temperature increases.

11. The method as recited in claim 1 including the step of widening the acceptable ranges around said running average ambient temperature and said desired grain moisture content when the available aeration time is greater than a predetermined amount.

12. The method as recited in claim 11 wherein the acceptable ranges are increased in several steps yielding wider ranges at each step when the available aeration time is greater than a corresponding step sequence of predetermined amounts.

13. The method as recited in claim 12 wherein the acceptable ranges are narrowed again to prior levels as the available aeration time is used and therefore decreased.

14. An apparatus for controlling aeration of stored grain that is of a specified type and that is to be maintained at or near a specified desired grain moisture content, comprising:

current ambient air temperature sensing means;

current ambient air relative humidity level sensing means;

current grain temperature sensing means;

means responsive to the current ambient air temperature sensing means for calculating and storing a running average ambient temperature covering a predetermined period of time;

means responsive to the current ambient air temperature and current ambient air relative humidity level sensing means for determing the equilibrium moisture content corresponding to said current ambient air temperature and relative humidity readings and the specified grain type; and means for calculating a daily aeration time based on the difference between the grain temperature and the running average ambient temperature;

means for calculating the available aeration time by summing daily aeration time for each day and subtracting therefrom an amount equal to time spent performing aeration; and means for comparing the current ambient air temperature to the running average ambient temperature, for comparing said equilibrium moisture content to the desired grain moisture content and for determining if available aeration time is non-zero, said means developing a signal to initiate grain aeration only when available aeration time is non-zero and both the current ambient air temperature and said equilibrium moisture content are within predetermined acceptable ranges of the running average ambient temperature and the desired grain moisture content, respectively.

15. A method for controlling aeration of stored grain which is of a specified type and which is to be maintained at or near a specified desired grain moisture content comprising the steps of:

measuring the current ambient air temperature;

measuring the current ambient air relative humidity level;

determining the equilibrium moisture content corresponding to said current ambient temperature and relative humidity readings and the specified grain type;

determining an average ambient temperature;

measuring the temperature of the grain;

determining a daily available amount of aeration time based on the difference between the grain temperature and the running average ambient temperature and a total available amount of aeration time based on the sum of daily available aeration time less aeration time actually used;

aerating said grain when said current ambient air temperature is within a predetermined acceptable range of said average temperature, said equilibrium moisture content is within a predetermined acceptable range of the desired grain moisture content and said total available amount of aeration time is not zero; and widening the acceptable range around said average ambient temperature when the total available amount of aeration time exceeds a predetermined value.

16. A method for controlling aeration of stored grain which is of a specified type and which is to be maintained at or near a specified desired grain moisture content comprising the steps of:

measuring the current ambient air temperature;

measuring the current ambient air relative humidity level;

determining the equilibrium moisture content corresponding to said current ambient temperature and relative humidity readings and the specified grain type;

determining an average ambient temperature;

measuring the temperature of the grain;

determining a daily available amount of aeration time based on the difference between the grain temperature and the running average ambient temperature and a total available amount of aeration time based on the sum of daily available aeration time less aeration time actually used;

aerating said grain when said current ambient air temperature is within a predetermined acceptable range of said average temperature, said equilibrium moisture content is within a predetermined acceptable range of the desired grain moisture content and said total available amount of aeration time is not zero; and widening the acceptable range around said desired grain moisture content when the total available amount of aeration time exceeds a predetermined value.

17. A method for controlling aeration of stored grain which is to be maintained at or near a specified desired grain moisture content comprising the steps of: measuring the current ambient air temperature; measuring the current ambient air relative humidity level;

determining the equilibrium moisture content corresponding to said current ambient temperature and relative humidity readings;

determining an average ambient temperature;

aerating said grain when said current ambient air temperature is within a predetermined acceptable range of said average temperature and said equilibrium moisture content is within a predetermined acceptable range of the desired grain moisture content; and widening the acceptable range around said desired grain moisture content when less than a predetermined amount of aeration has occurred, said widening of the range being unsymmetrical such that when dry weather conditions are expected to prevail the range is broader on the wet side of the desired grain moisture content and when wet weather conditions are expected to prevail the range is broader on the dry side of the desired grain moisture content.

18. A method for controlling aeration of stored grain which is to be maintained at or near a specified desired grain moisture content comprising the steps of:

measuring the current ambient air temperature;

measuring the current ambient air relative humidity level;

determining from the specified desired grain moisture content and the current ambient temperature a desired relative humidity value that will result in the specified desired grain moisture content;

determining an average ambient temperature;

measuring the temperature of the grain;

determining an available amount of aeration time for a specified interval based on the difference between the grain temperature and the average ambient temperature;

calculating available aeration time by summing said available amount of aeration time for each specified interval and subtracting therefrom an amount equal to time spent performing aeration;

aerating said grain only when said available aeration time is not equal to zero and when said current ambient air temperature is within a predetermined acceptable range of said average temperature and said ambient relative humidity level is within a predetermined acceptable range of the desired relative humidity value; and widening the acceptable range around said desired relative humidity value when less than a predetermined amount of aeration has occurred.

* * * * *